US012680255B2

(12) United States Patent
Dubreuil et al.

(10) Patent No.: US 12,680,255 B2
(45) Date of Patent: Jul. 14, 2026

(54) DEVICE FOR GUIDING AND VERTICALLY HOLDING A MONOPILE AND METHOD FOR INSTALLING A MONOPILE USING SUCH A DEVICE

(71) Applicant: SAIPEM S.A., Montigny le Bretonneux (FR)

(72) Inventors: Yves Dubreuil, Montigny le Bretonneux (FR); Luca Donadi, Montigny le Bretonneux (FR); Bertrand Brisset, Montigny le Bretonneux (FR)

(73) Assignee: SAIPEM S.A., Montigny le Bretonneux (FR)

( * ) Notice: Subject to any disclaimer, the term of this patent is extended or adjusted under 35 U.S.C. 154(b) by 62 days.

(21) Appl. No.: 18/874,763

(22) PCT Filed: Jun. 19, 2023

(86) PCT No.: PCT/FR2023/050890
§ 371 (c)(1),
(2) Date: Dec. 13, 2024

(87) PCT Pub. No.: WO2023/247874
PCT Pub. Date: Dec. 28, 2023

(65) Prior Publication Data

US 2025/0376826 A1 Dec. 11, 2025

(30) Foreign Application Priority Data

Jun. 24, 2022 (FR) ..... 2206344

(51) Int. Cl.
*E02D 13/04* (2006.01)
*E02D 7/06* (2006.01)

(52) U.S. Cl.
CPC ..... *E02D 13/04* (2013.01); *E02D 7/06* (2013.01)

(58) Field of Classification Search
CPC .. E02D 7/06; E02D 7/16; E02D 13/04; E02B 2017/0039
See application file for complete search history.

(56) References Cited

U.S. PATENT DOCUMENTS 5,794,716 A * 8/1998 White ..... E02D 13/04 173/189
6,354,767 B1 * 3/2002 Jones ..... E02D 13/04 405/232

(Continued)

FOREIGN PATENT DOCUMENTS

CA 2784866 A1 7/2011
EP 1304415 A1 4/2023

(Continued)

OTHER PUBLICATIONS

French Search Report from corresponding FR Application No. 2206344 dated Feb. 7, 2023.

(Continued)

*Primary Examiner* — Benjamin F Fiorello
(74) *Attorney, Agent, or Firm* — Workman Nydegger

(57) ABSTRACT

A device is for guiding and vertically maintaining a tubular monopile when it is placed in an excavation made in a seabed, filled with compacted granular materials and consolidated by a metal reinforcement tube. The device includes a support structure mounted on four feet, each adjustable in height, a frame for positioning the support structure relative to the reinforcement tube having a closed U shape, and a cage mounted inside the support structure above the positioning frame to receive the monopile. The cage has a closed (Continued)

low portion and a high portion provided with a door to allow lateral introduction of the monopile into the cage.

15 Claims, 8 Drawing Sheets

(56) References Cited

U.S. PATENT DOCUMENTS

| | | | | |
|---|---|---|---|---|
| 8,801,334 | B2 * | 8/2014 | Paulus | E02D 27/52 405/227 |
| 8,911,180 | B2 * | 12/2014 | Finkenzeller | E21B 7/124 175/7 |
| 11,603,639 | B2 | 3/2023 | Jean et al. | |
| 2012/0298419 | A1 * | 11/2012 | Finkenzeller | E21B 7/124 175/6 |
| 2021/0123202 | A1 * | 4/2021 | Lebon | E02D 13/00 |
| 2022/0081864 | A1 * | 3/2022 | Pipsair | E02D 13/04 |

FOREIGN PATENT DOCUMENTS

| | | | |
|---|---|---|---|
| NL | 2019065 | B1 | 12/2018 |
| WO | 2019/057827 | A1 | 3/2019 |
| WO | 2020/025864 | A1 | 2/2020 |

OTHER PUBLICATIONS

International Search Report from corresponding PCT Application No. PCT/FR2023/050890 dated Sep. 20, 2023.

* cited by examiner

DEVICE FOR GUIDING AND VERTICALLY HOLDING A MONOPILE AND METHOD FOR INSTALLING A MONOPILE USING SUCH A DEVICE

TECHNICAL FIELD

The present invention relates to the general field of the installation of metal monopiles in a rocky soil, in particular at sea in a rocky seabed covered with a layer of loose soil.

A non-limiting example of the field of application of the invention is the one of placing the foundations of an offshore wind farm.

PRIOR ART

Typically, an offshore wind turbine is installed at sea using a foundation consisting of a tubular metal monopile with a very large diameter, generally of the order of 7 to 8 m, which is inserted about thirty meters deep into the rocky seabed.

For this purpose, it is known to drill the seabed composed of a bedrock covered by a layer of loose soil with a hole of given diameter and depth to install the pile therein. This drilling is most often carried out from a barge supporting a drilling and cementing workshop. Cement is then poured into the hole to seal the pile in the hole. When the bearing capacity of the pile thus installed is ensured by the behavior of the cement, the pile is released to be able to move the barge carrying the drilling and cementing workshop to the location of the next wind turbine.

This technique of placing the foundations of an offshore wind farm, however, has many drawbacks. Particularly, drilling the hole and placing the pile therein leads to a risk of instability of the walls of the hole in the loose soil layer. Moreover, this technique results in excessive consumption of cement when sealing the pile in the seabed. In addition, the properties of the cement tend to deteriorate in a marine environment and under the cyclical conditions of swell and wind forces on the pile. Furthermore, this technique requires ensuring the verticality and the stability of the pile during its sealing, which requires substantial installation means and time.

To overcome these drawbacks, a method for installing a tubular metal monopile in a rocky soil has been proposed in publication WO 2020/025864, comprising successively installing a metal tube up to the roof of the rock with a larger diameter than the drill to maintain the loose soil layer, drilling the rocky soil to form a cavity of predetermined diameter and depth, filling the cavity with a granular material, arranging the granular material present in the cavity by vibration, and installing the monopile in the cavity by vibro-sinking or by piling. This installation technique is particularly advantageous in that it makes it possible to eliminate the need to seal the monopile with cement with all the drawbacks that this entails.

DISCLOSURE OF THE INVENTION

In practice, to implement such an installation technique, there is a need to have a device for guiding and vertically maintaining the monopile when it is placed in the excavation made in a seabed and filled with compacted granular materials.

In accordance with the invention, this need is achieved thanks to a device for guiding and vertically maintaining a tubular monopile when it is placed in an excavation made in a seabed, filled with compacted granular materials and consolidated by a metal reinforcement tube, comprising:

- a support structure intended to be positioned vertically to the excavation made in the seabed and mounted on at least four feet which are each adjustable in height;
- a frame for positioning the support structure relative to the reinforcement tube, the positioning frame having a closed U shape, being mounted on a low portion of the support structure and being intended to ensure the positioning of the support structure relative to an upper end of the reinforcement tube;
- a cage extending along a longitudinal axis and mounted inside the support structure above the positioning frame in order to receive the monopile, the cage comprising a closed low portion and a high portion provided with a door able to open to allow lateral introduction of the monopile into the cage and able to close to maintain the monopile in the cage;
- the high portion of the cage comprises a plurality of damping pads distributed around the longitudinal axis of the cage, dimensioned to allow distributed contact with the monopile, and able to dampen the dynamics of the monopile and come radially into abutment against the monopile when it is introduced into the cage in order to stabilize and modify its inclination relative to the longitudinal axis of the cage; and
- the low portion of the cage comprises a plurality of blades extending along the longitudinal axis of the cage and distributed around it, said blades being dimensioned to allow distributed contact with the monopile, able to come radially into abutment against the monopile when it is introduced into the cage in order to guide it during its descent into the cage and to modify its inclination relative to the longitudinal axis of the cage until reaching a sufficient soil resistance to naturally maintain the positioning in angle and in translation.

The device according to the invention has many advantages due to its structure. Particularly, this device allows the pre-installation of the support structure above the reinforcement tube, as well as the adjustment of the support structure to the profile of the seabed. Furthermore, the cage with its high portion equipped with a door authorizes lateral introduction of the monopile, which allows limiting the height criteria of the lifting crane.

During the loading of the monopile, the presence of the damping pads in the high portion of the cage makes it possible to absorb the movement energy of the monopile due to the hydrodynamic loads. The monopile is then captured in position and guided gradually in its descent, implementing during the descent, in addition to the damping pads, blades positioned in the low portion of the cage to achieve the required verticality.

At least some of the damping pads positioned at the level of the high portion of the cage can be mounted on a cylinder so as to allow modifying their position along a radial direction.

In this case, the damping pads mounted on a cylinder are preferably two in number and are associated with two diametrically opposite fixed damping pads so as to make sure to homogenously maintain the monopile around the longitudinal axis of the cage.

Each damping pad positioned at the level of the high portion of the cage can comprise a rigid shield which is intended to come into abutment against the monopile to distribute the contact pressure and limit friction, and which is mounted on a fixed support by means of at least one fender made of elastomer.

In addition, the damping pads positioned at the level of the high portion of the cage can be distributed over at least two rows longitudinally spaced from each other.

Moreover, at least some of the blades positioned at the level of the low portion of the cage can be mounted on slides so as to allow modifying their position along a radial direction.

Advantageously, the door of the cage comprises pads intended to absorb shocks and to ensure guidance of the monopile during its lateral introduction into the cage.

Also advantageously, the positioning frame is movable in rotation around two axes perpendicular to the longitudinal axis of the cage and is movable in translation along said longitudinal axis of the cage. This feature makes it easier to laterally install the reinforcement tube.

Advantageously again, each foot of the support structure comprises a plate articulated around an axis perpendicular to the longitudinal axis of the cage.

Preferably, one of the feet ends at a high end with a cone for receiving ballast.

The support structure can comprise two central columns which end at a high end with a cone for receiving a hydraulic lifting tool.

In addition, the frame for positioning the support structure can comprise a removable closing bar.

The invention also relates to a method for placing a tubular monopile in an excavation made in the seabed, successively comprising:

- consolidating the excavation with a metal reinforcement tube,
- drilling the seabed to the desired depth,
- filling the excavation with granular materials then compacting the granular materials,
- depositing on the seabed vertically to the excavation a device as defined above, the frame for positioning the support structure being introduced around the upper end of the reinforcement tube,
- lifting the monopile from above,
- guiding the monopile to introduce it inside the cage by passing the lower end of the monopile laterally through the door of the cage,
- lowering the monopile into the cage,
- partially driving the monopile into the compacted granular materials while correcting its inclination relative to the longitudinal axis of the cage to correct verticality defects of the monopile, and
- recovering the device.

Preferably, the compaction of the granular materials is carried out by vibration and the partial driving of the monopile into the compacted granular materials is carried out by vibro-sinking.

Also preferably, the method further comprises the adjustment of the cage to the diameter of the monopile by setting the pads positioned at the level of the high portion of the cage and the blades positioned at the level of the low portion of said cage.

DESCRIPTION OF THE EMBODIMENTS

Figure 1:
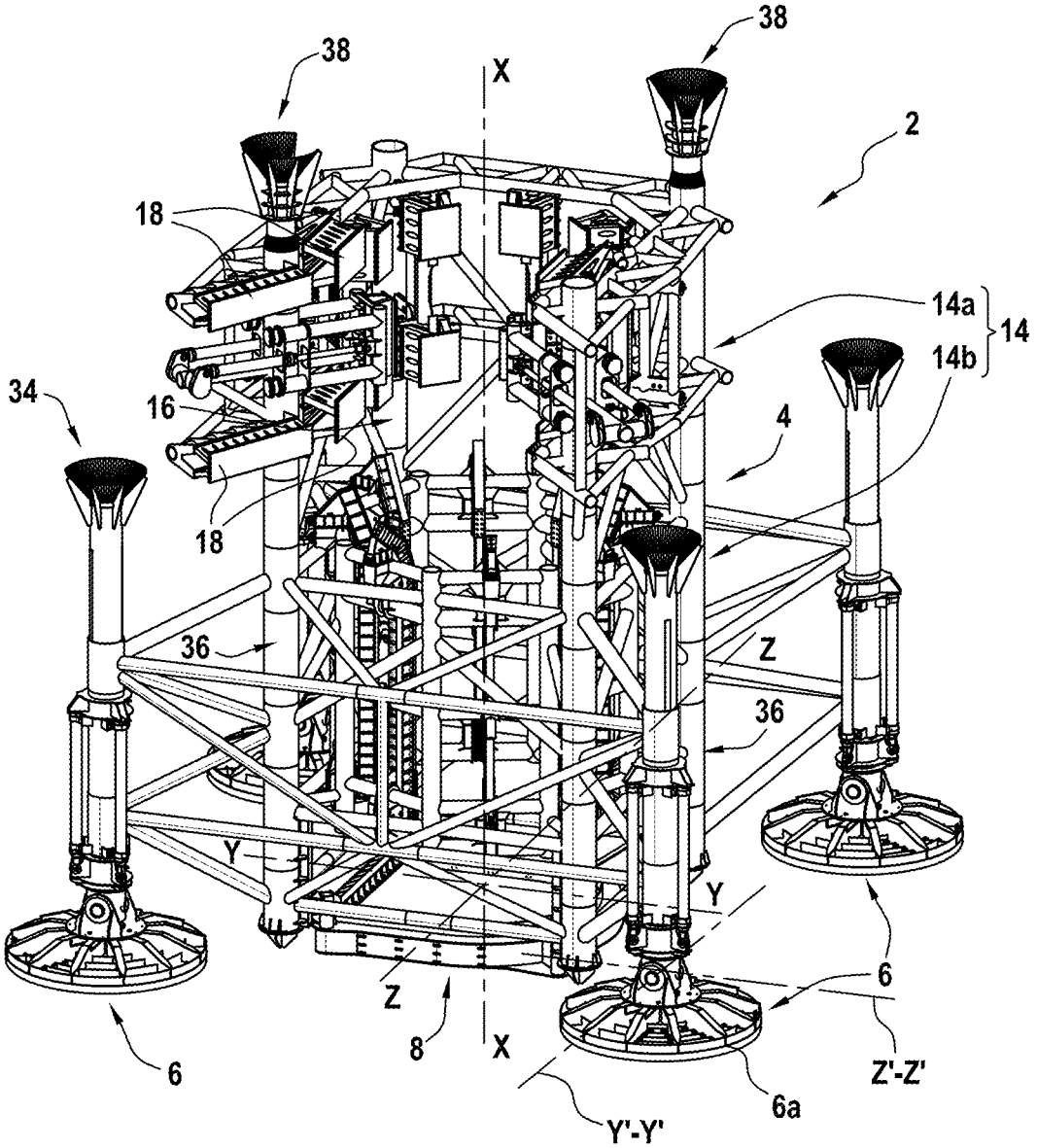
FIG. 1 is a perspective view of a device for guiding and vertically maintaining a monopile according to the invention.

The invention relates to a device for guiding and vertically maintaining a tubular monopile as represented in FIG. 1.

It finds a particularly advantageous application in placing such a monopile in an excavation made in a seabed, filled with compacted granular materials and consolidated by a metal reinforcement tube making it possible to maintain the loose soil layer as described in particular in publication WO 2020/025864.

According to the invention, the device 2 comprises in particular a support structure 4 which is intended to be positioned vertically to the excavation made in the seabed and which is mounted on at least four feet 6 which are each adjustable in height.

The device 2 further comprises a frame 8 allowing the positioning of the support structure 4 relative to the metal reinforcement tube (not represented in FIG. 1) which is used to consolidate the excavation.

Figure 2:
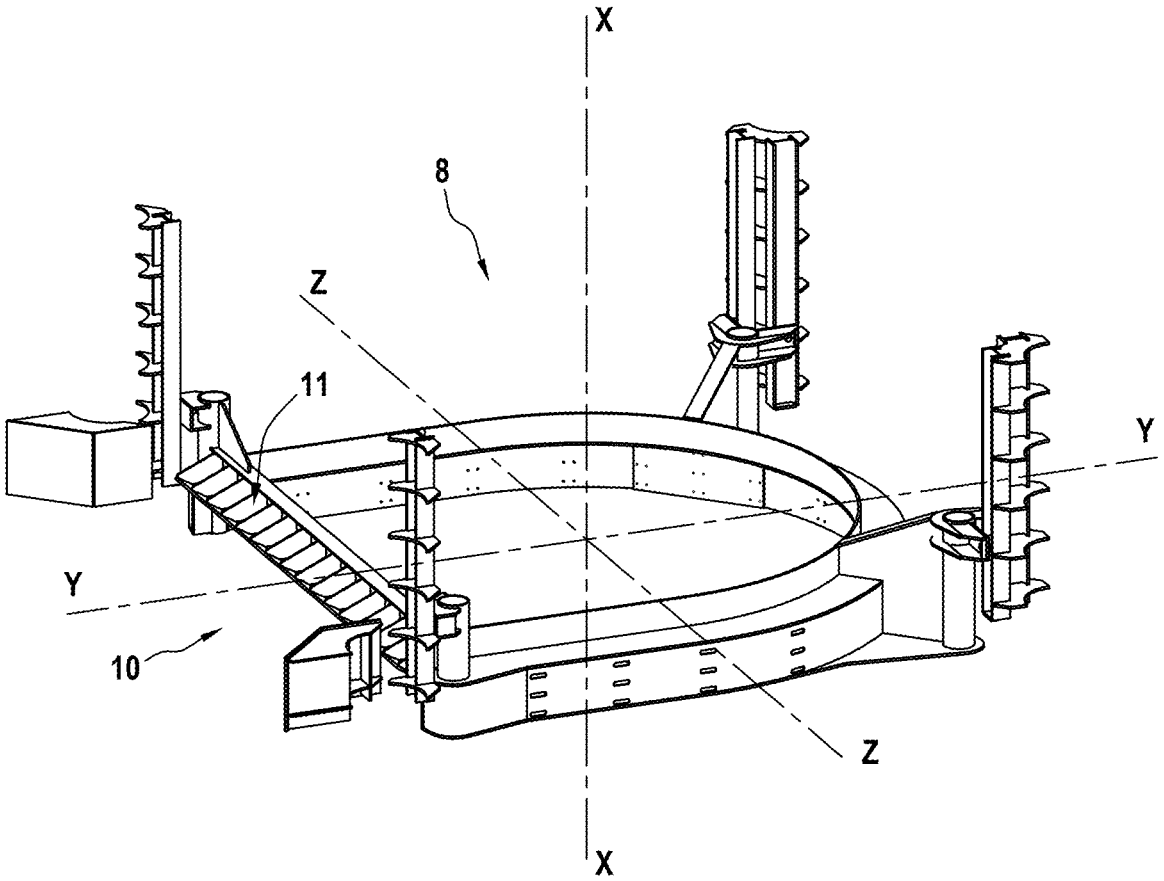
FIG. 2 shows in detail the frame for positioning the support structure of the device of FIG. 1.

As more specifically represented in FIG. 2, this positioning frame 8 has a U shape and is mounted on a low portion of the support structure 4. It is intended to ensure the positioning of the support structure relative to the upper end of the reinforcement tube.

To this end, the positioning frame 8 comprises a lateral opening 10 for positioning the upper end of the reinforcement tube.

In addition, the lateral opening 10 of the positioning frame can be closed by means of a removable closing bar 11.

Moreover, to allow adaptation to the surface of the seabed and to facilitate the lateral positioning of the reinforcement tube, the positioning frame 8 is advantageously movable in rotation around two axes Y-Y and Z-Z perpendicular to the longitudinal axis X-X of the support structure and is movable in translation along this longitudinal axis X-X.

For example, a rotation capacity of more or less 5° can be provided both relative to the axis Y-Y and relative to the axis Z-Z. This rotation capacity is for example obtained thanks to the clearance of the bearings in vertical guides oriented along the axis X-X.

The device 2 also comprises a cage 14 whose longitudinal axis coincides with the longitudinal axis X-X of the support structure 4 and which is mounted inside it above the positioning frame 8 in order to receive the monopile.

More specifically, the cage 14 comprises a low portion 14*a* which is closed and a high portion 14*b* which is provided with a door 16 able to open to allow lateral introduction of the monopile into the cage and able to close to maintain the monopile in the cage.

The door 16 of the cage 14 comprises pads 18 which are intended to absorb the shocks and to ensure a guidance of the monopile during its lateral introduction into the cage.

Moreover, the high portion 14*b* of the cage comprises a plurality of damping pads 20 which are distributed around the longitudinal axis X-X of the cage. These damping pads 20 are able to come radially into abutment against the monopile when it is introduced into the cage in order to stabilize and modify its inclination relative to the longitudinal axis of the cage, without constraining the monopile too strongly, thus ensuring its preservation.

Figure 3:
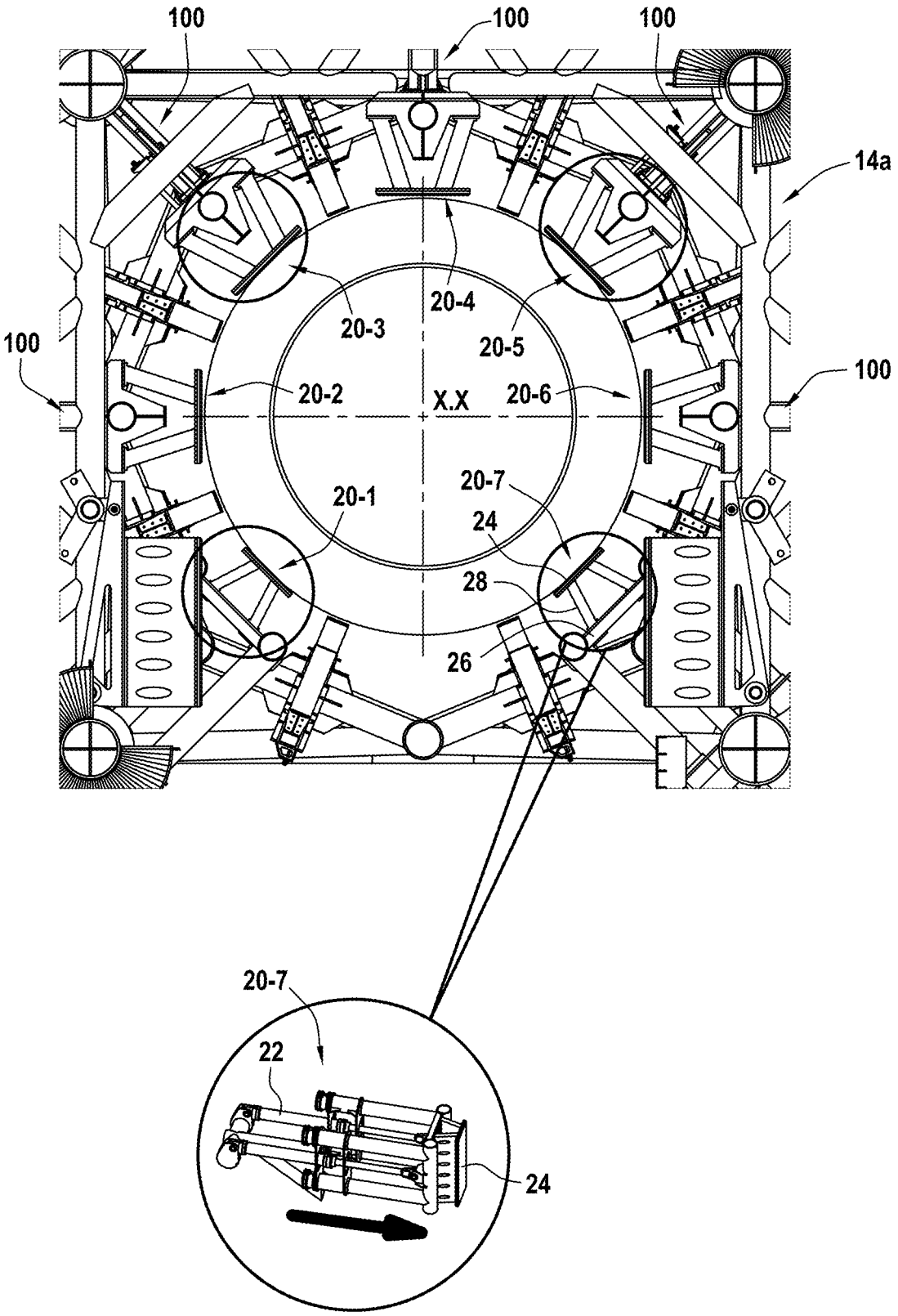
FIG. 3 shows in detail the damping pads of the high portion of the cage of the device of FIG. 1.

To this end, as represented in more detail in FIG. 3, at least some of the damping pads positioned at the level of the high portion 14*b* of the cage are mounted on a cylinder so as to allow modifying their position along a radial direction.

In the example of FIG. 3, the high portion 14*b* of the cage comprises seven damping pads 20-1 to 20-7 evenly distributed around the longitudinal axis X-X of the cage. Among these damping pads, two of them (namely the damping pads 20-1 and 20-7 which frame the opening of the door 16) are mounted on a cylinder 22 and are associated with two diametrically opposite fixed damping pads (namely the damping pads 20-3 and 20-5) so as to make sure to homogenously maintain the monopile around the longitudinal axis X-X of the cage.

The position of the fixed supports 26 is adjustable by means of a slide 100 (FIG. 3) for adapting the structure according to the invention to several monopile diameters (for example 3 diameters to be set as needed: 7.0 m, 7.5 m and 7.75 m).

Generally, each damping pad 20 positioned at the level of the high portion 14*b* of the cage comprises a rigid shield 24 which is intended to come into abutment against the monopile to distribute the contact pressure and limit friction, and a fixed support 26 on which the rigid shield is mounted by means of at least one fender 28 made of elastomer.

In the exemplary embodiment of FIG. 3, the rigid shield 24 of each damping pad is mounted on the fixed support 26 by means of two fenders 28 made of elastomer.

In one embodiment not represented in the figures, the damping pads which are positioned at the level of the high portion of the cage are distributed over at least two rows spaced longitudinally from each other (i.e. spaced along the longitudinal axis of the cage).

Figure 4:
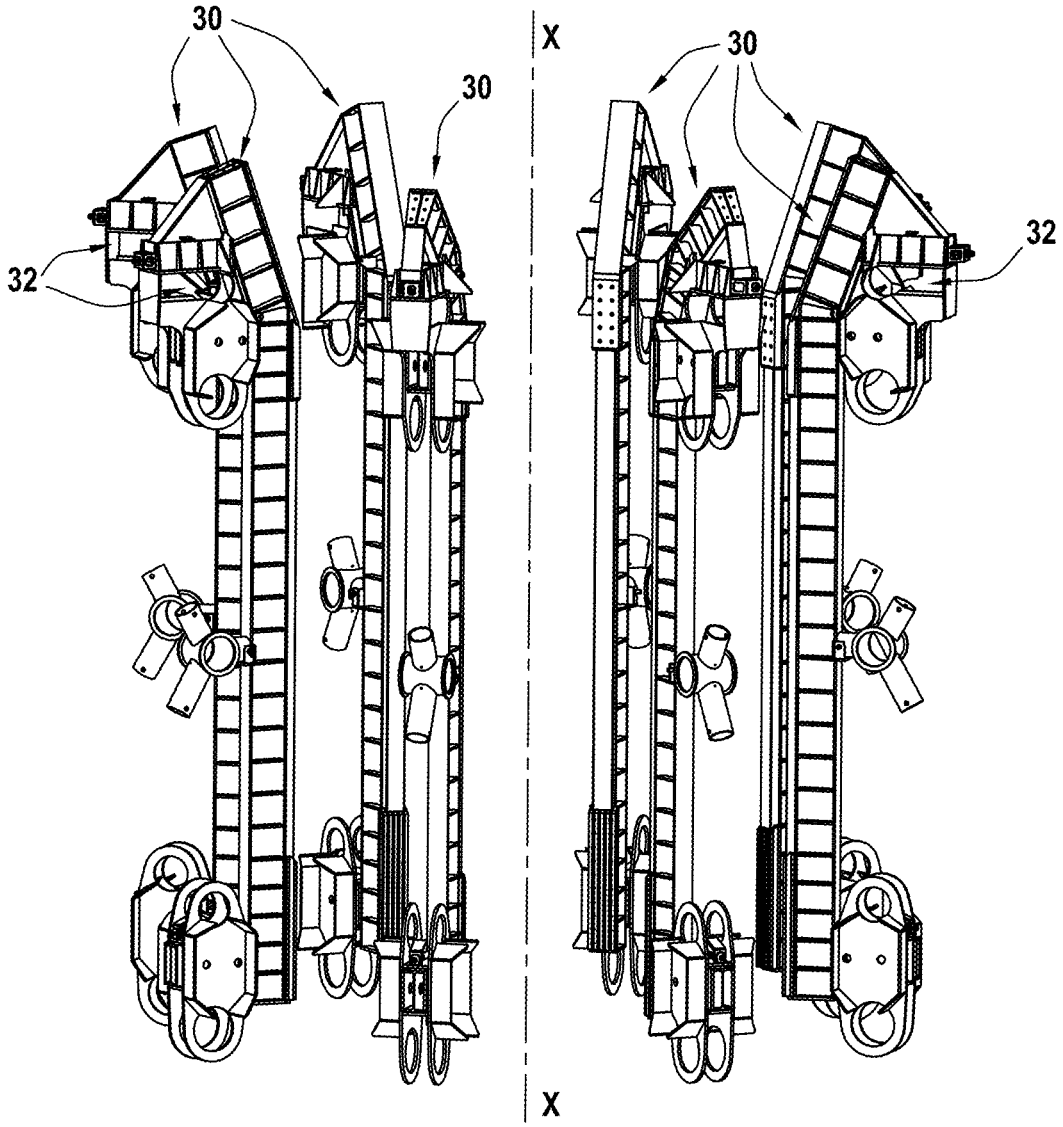
FIG. 4 shows in detail the blades of the low portion of the cage of the device of FIG. 1.

Still according to the invention, as represented in FIG. 4, the low portion 14*a* of the cage 14 comprises a plurality of blades 30 which extend along the longitudinal axis X-X and which are distributed around it.

These blades 30 are able to come radially into abutment against the monopile when it is introduced into the cage in order to guide it during its descent into the cage and to modify its inclination relative to the longitudinal axis of the cage (for example of the order of more or less 0.25° relative to the vertical). The blades 30 thus ensure a tightening of the guidance, leading to an ever more accurate control of the angle of the monopile.

Preferably, these blades 30 are eight in number and at least some of them are mounted on slides 32 so as to allow modifying their position along a radial direction.

According to one advantageous arrangement represented in FIG. 1, each foot 6 of the support structure 4 comprises a plate 6*a* articulated around two axes Y'-Y', Z'-Z' perpendicular to the longitudinal axis X-X of the cage in order to allow adjusting the positioning of the support structure to the surface profile of the seabed.

According to another advantageous arrangement, one of the feet 6 of the support structure ends at a high end with a cone 34 for receiving ballast.

According to yet another advantageous arrangement, the support structure 4 comprises two central columns 36 which each end at a high end with a cone 38 for receiving a hydraulic lifting tool.

At the foot of the central columns 36, the rigidity of the system makes it possible to transmit the forces during transport, considering that the structure is secured via the feet of these columns to the deck of the vessel.

In relation to FIGS. 5A to 5D, one example of placing a tubular monopile in an excavation made in the seabed using the device as previously described will now be described.

According to one preliminary step not represented in the figures, a metal reinforcement tube 44 is placed in the loose soil S-M up to the roof of the rock S-R, then an excavation 46 is made in the seabed and the rock S-R is drilled to the desired depth. The excavation 46 is then filled with granular materials which are then compacted by vibration as described in the publication WO 2020/025864, the compacted granular materials coming up to above the seabed but under the upper portion of the metal reinforcement tube.

The device 2 according to the invention is then deposited on the seabed vertically to the excavation 46 from a surface installation vessel, the frame for positioning 8 the support structure being introduced around the upper end of the reinforcement tube 44.

Figure 5A:
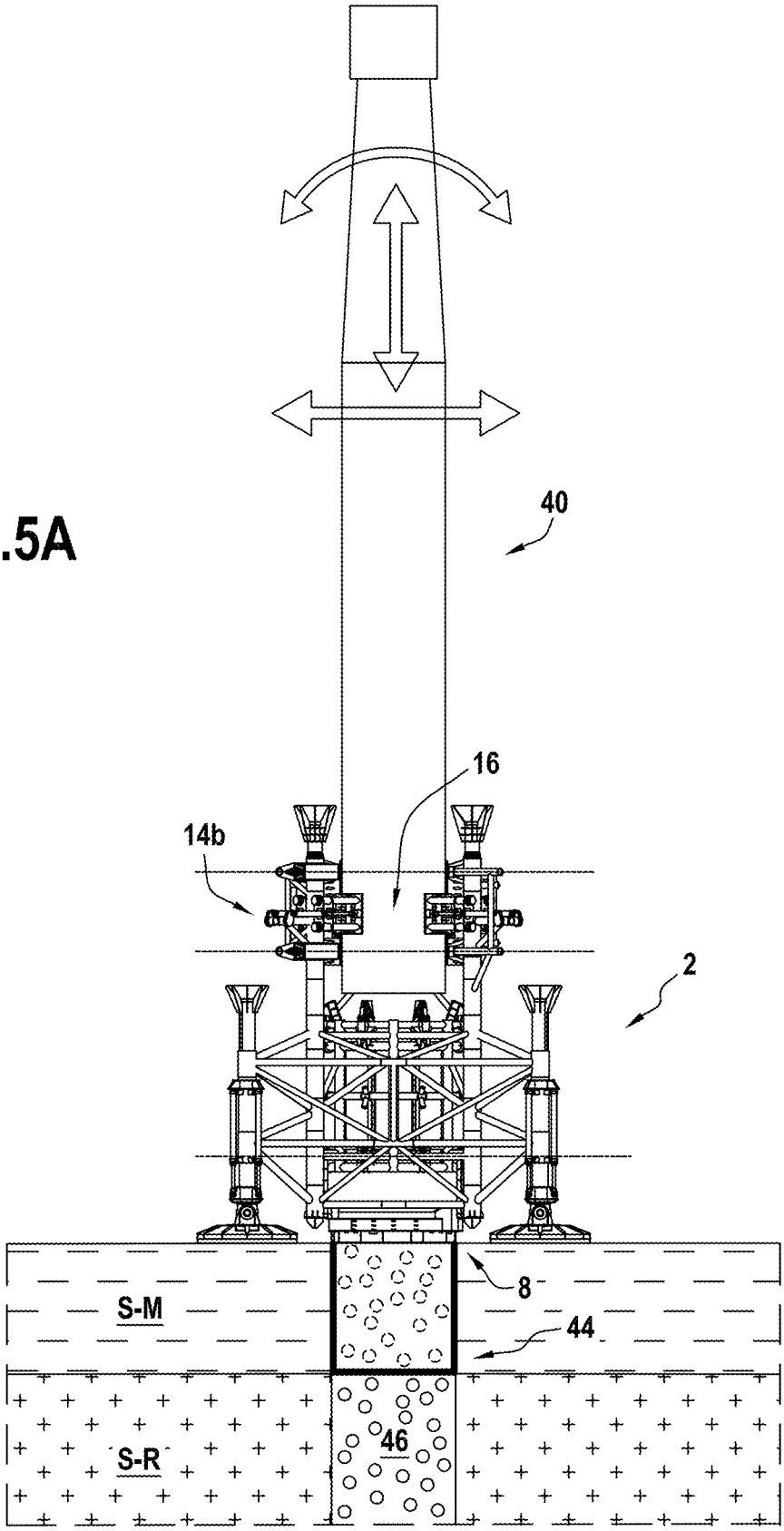
FIGS. 5A, 5B, 5C and 5D represent one example of different steps of a method for placing a tubular monopile in an excavation made in the seabed using the device according to the invention.

Once correctly positioned and aligned, the door 16 of the cage is opened to allow the lateral introduction of the monopile 40. For this purpose, the surface installation vessel lifts the monopile 40 from above using a lifting crane (not represented in the figures) and guides it to introduce it inside the cage by passing the lower end of the monopile laterally through the door of the cage (FIG. 5A).

The lateral introduction of the monopile into the cage of the support structure makes it possible to limit the lifting height of the monopile (compared to a vertical introduction).

During this introduction, the pads positioned at the level of the cage door allow absorbing the shocks and ensure the guiding of the monopile inside the cage and the damping pads distributed in the high portion of the cage allow vertically stabilizing the monopile, without excessively constraining it. The damping system in fact allows tolerating significant dynamics of the monopile and thus using an installation vessel of the floating type, not moored to the soil.

Figure 5B:
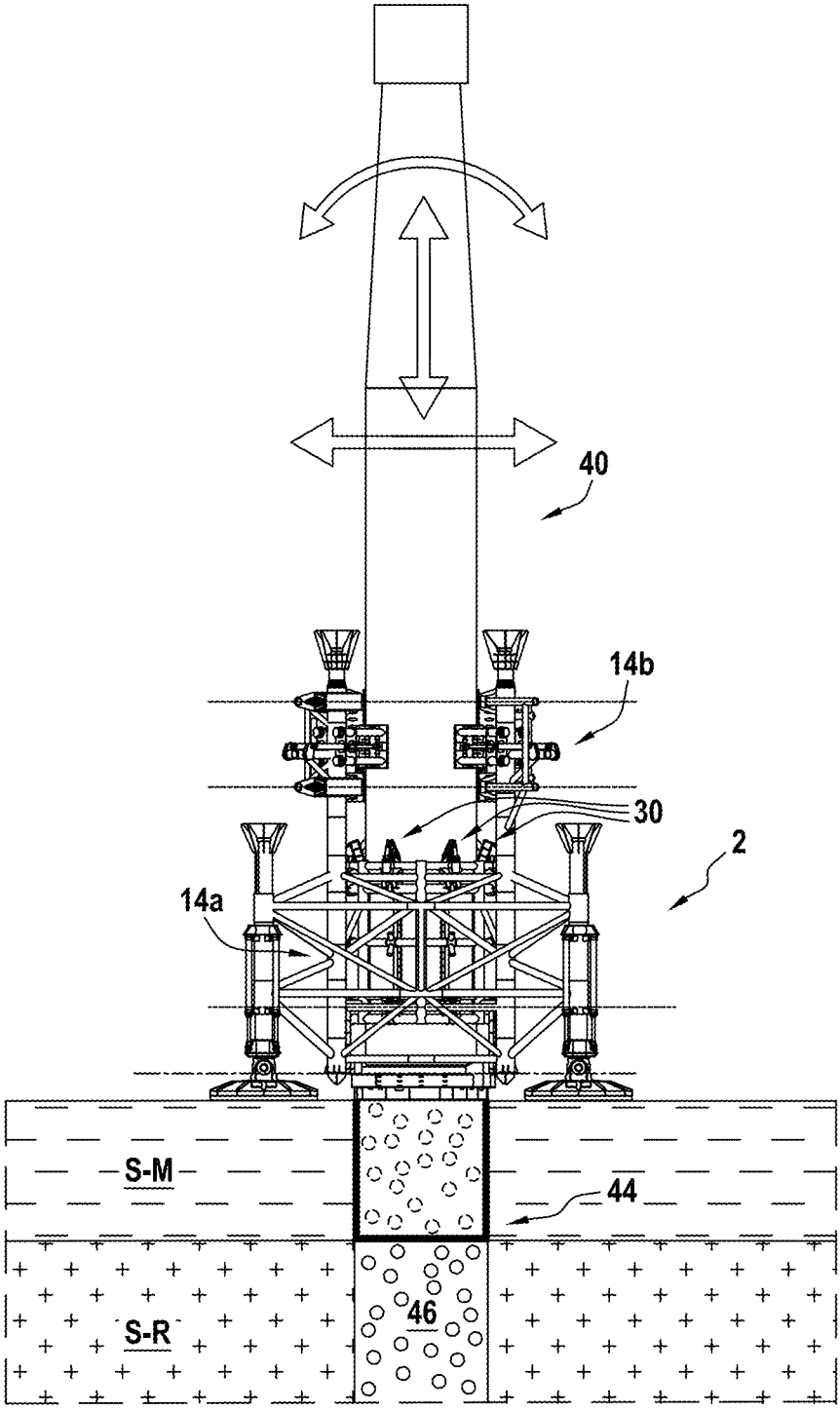

Once the monopile 40 is introduced into the high portion 14*b* of the cage, it is guided by means of the lifting crane towards the bottom of the cage (FIG. 5B). First, the monopile 40 passes between the blades of the low portion of the cage, tightening the guidance, then touches the roof of the compacted granular materials filling the excavation 46.

Figure 5C:
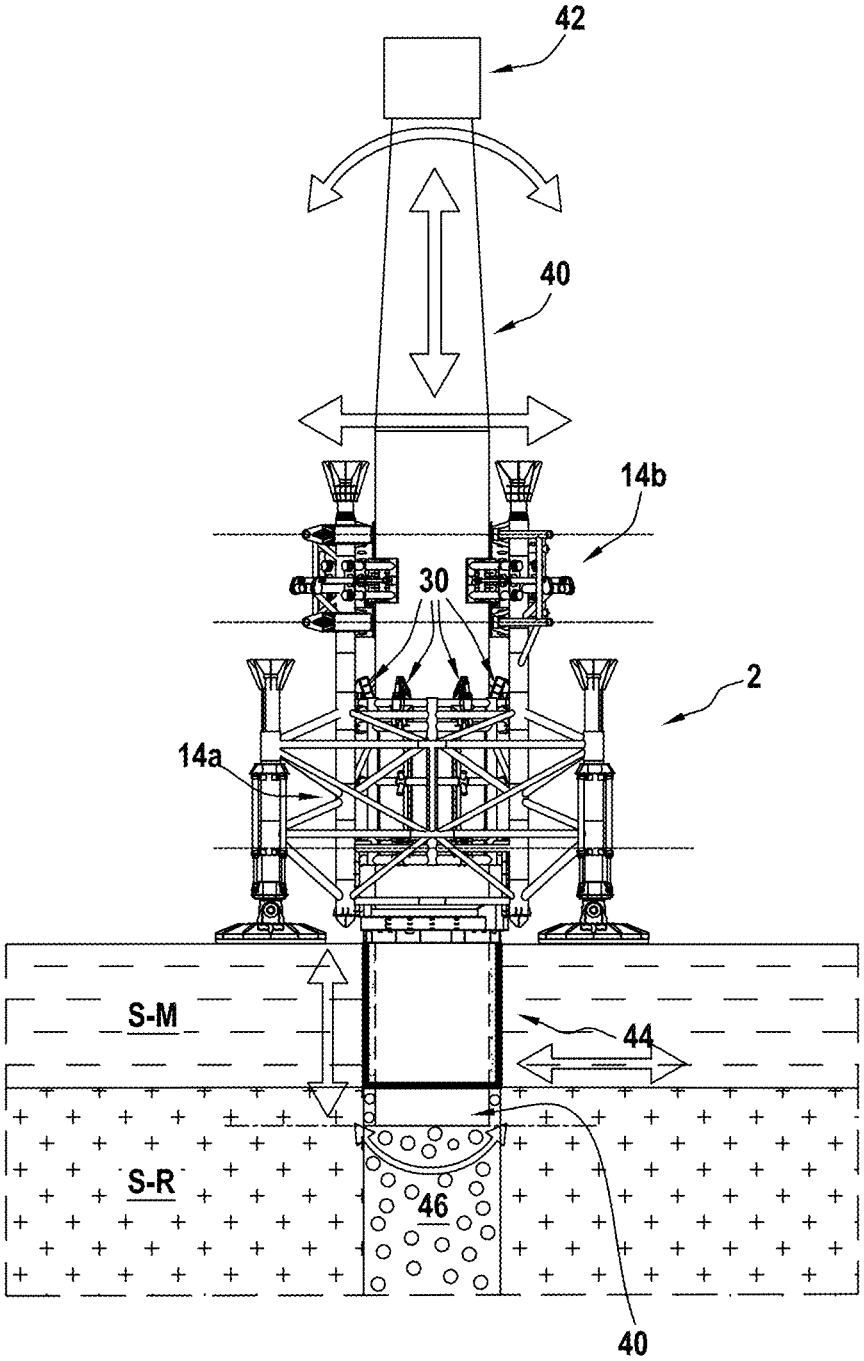

The monopile 40 is then partially driven into the compacted granular materials, preferably initially by gravity and then by vibro-sinking implemented by means of a vibrator 42 mounted on the upper end of the monopile and activated by the lifting crane (FIG. 5C).

During this operation of partially driving the monopile, the inclination of the latter relative to the longitudinal axis X-X of the cage is corrected in particular by means of the blades of the low portion of the cage so as to correct any defects in the verticality of the monopile.

Figure 5D:
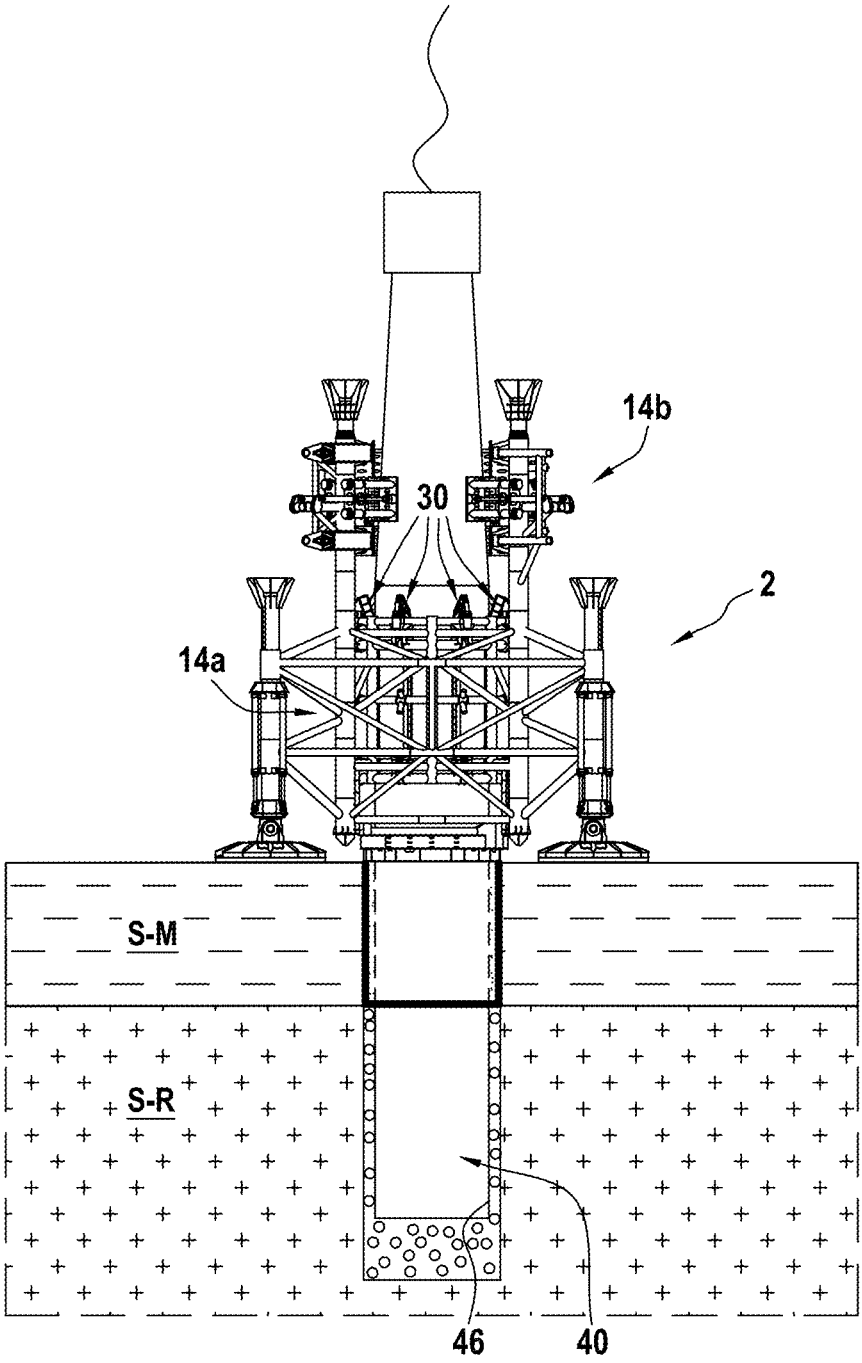

When the monopile 40 is sufficiently driven into the soil (the driving depth is of about 15 m-20 m), the participating soil is sufficiently rigid to maintain the monopile in a horizontal and angular position. A last setting using the damping pads and the blades of the cage is then carried out to gently finalize the vertical positioning of the monopile to more or less 0.25° (FIG. 5D).

It should be noted that once this operation of vertically placing the monopile has been carried out, the soil maintains the latter in a lateral and angular position and the vibro-sinking is continued to reach the desired depth, while keeping the verticality.

In a final step not represented in the figures, the device can be recovered and brought back to the surface on the installation vessel.

Preferably, the method comprises, in addition to the adjustment of the cage to the diameter of the monopile by setting the pads positioned at the level of the high portion of the cage and the blades positioned at the level of the low portion of said cage.

The invention claimed is:

1. A device for guiding and vertically maintaining a tubular monopile when it is placed in an excavation made in a seabed, filled with compacted granular materials and consolidated by a metal reinforcement tube, comprising:

a support structure intended to be positioned vertically to the excavation made in the seabed and mounted on at least four feet which are each adjustable in height;

a frame for positioning the support structure relative to the reinforcement tube, the positioning frame having a closed U shape, being mounted on a low portion of the support structure and being intended to ensure the positioning of the support structure relative to an upper end of the reinforcement tube;

a cage extending along a longitudinal axis (X-X) and mounted inside the support structure above the positioning frame in order to receive the monopile, the cage comprising a closed low portion and a high portion provided with a door able to open to allow lateral introduction of the monopile into the cage and able to close to maintain the monopile in the cage;

the high portion of the cage comprises a plurality of damping pads distributed around the longitudinal axis (X-X) of the cage, dimensioned to allow distributed contact with the monopile, and able to dampen the dynamics of the monopile and come radially into abutment against the monopile when it is introduced into the cage in order to stabilize and modify its inclination relative to the longitudinal axis of the cage; and the low portion of the cage comprises a plurality of blades extending along the longitudinal axis (X-X) of the cage and distributed around it, said blades being dimensioned to allow distributed contact with the monopile, able to come radially into abutment against the monopile when it is introduced into the cage in order to guide it during its descent into the cage and to modify its inclination relative to the longitudinal axis of the cage until reaching a sufficient soil resistance to naturally maintain the positioning in angle and in translation.

2. The device according to claim 1, wherein at least some of the damping pads positioned at the level of the high portion of the cage are mounted on a cylinder so as to allow modifying their position along a radial direction.

3. The device according to claim 2, wherein the damping pads mounted on a cylinder are two in number and are associated with two diametrically opposite fixed damping pads so as to make sure to homogeneously maintain the monopile around the longitudinal axis of the cage.

4. The device according to claim 1, wherein each damping pad positioned at the level of the high portion of the cage comprises a rigid shield which is intended to come into abutment against the monopile to distribute the contact pressure and limit friction, and which is mounted on a fixed support by means of at least one fender made of elastomer.

5. The device according to claim 1, wherein the damping pads positioned at the level of the high portion of the cage are distributed over at least two rows longitudinally spaced from each other.

6. The device according to claim 1, wherein at least some of the blades positioned at the level of the low portion of the cage are mounted on slides so as to allow modifying their position along a radial direction.

7. The device according to claim 1, wherein the door of the cage comprises pads intended to absorb shocks and to ensure guidance of the monopile during its lateral introduction into the cage.

8. The device according to claim 1, wherein the positioning frame is movable in rotation around two axes (Y-Y, Z-Z) perpendicular to the longitudinal axis (X-X) of the cage and is movable in translation along said longitudinal axis of the cage.

9. The device according to claim 1, wherein each foot of the support structure comprises a plate articulated around an axis perpendicular to the longitudinal axis (X-X) of the cage.

10. The device according to claim 1, wherein one of the feet ends at a high end with a cone for receiving ballast.

11. The device according to claim 1, wherein the support structure comprises two central columns which end at a high end with a cone for receiving a hydraulic lifting tool.

12. The device according to claim 1, wherein the frame for positioning the support structure comprises a removable closing bar.

13. A method for placing a tubular monopile in an excavation made in the seabed, successively comprising:

consolidating the excavation with a metal reinforcement tube, drilling the seabed to the desired depth, filling the excavation with granular materials then compacting the granular materials, depositing on the seabed vertically to the excavation a device according to claim 1, the frame for positioning the support structure being introduced around the upper end of the reinforcement tube;

lifting the monopile from above;

guiding the monopile to introduce it inside the cage by passing the lower end of the monopile laterally through the door of the cage;

lowering the monopile into the cage;

partially driving the monopile into the compacted granular materials while correcting its inclination relative to the longitudinal axis of the cage to correct verticality defects of the monopile; and recovering the device.

14. The method according to claim 13, wherein the compaction of the granular materials is carried out by vibration and the partial driving of the monopile into the compacted granular materials is carried out by vibro-sinking.

15. The method according to claim 13, further comprising the adjustment of the cage to the diameter of the monopile by setting the pads positioned at the level of the high portion of the cage and the blades positioned at the level of the low portion of said cage.

* * * * *